US008011337B2

(12) United States Patent
Hayashi

(10) Patent No.: US 8,011,337 B2
(45) Date of Patent: Sep. 6, 2011

(54) VALVE TIMING ADJUSTING APPARATUS

(75) Inventor: Masashi Hayashi, Okazaki (JP)

(73) Assignee: Denso Corporation, Kariya (JP)

( * ) Notice: Subject to any disclaimer, the term of this patent is extended or adjusted under 35 U.S.C. 154(b) by 367 days.

(21) Appl. No.: 12/349,074

(22) Filed: Jan. 6, 2009

(65) Prior Publication Data

US 2009/0173298 A1 Jul. 9, 2009

(30) Foreign Application Priority Data

Jan. 7, 2008 (JP) ..... 2008-000756

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | |
|---|---|---|---|
| 6,311,654 | B1 | 11/2001 | Ushida et al. |
| 6,450,138 | B1 | 9/2002 | Kinugawa et al. |
| 6,457,447 | B1 | 10/2002 | Sato et al. |

FOREIGN PATENT DOCUMENTS

| | | |
|---|---|---|
| JP | 11-294121 | 10/1999 |
| JP | 2002-122009 | 4/2002 |
| JP | 2007-120406 | 5/2007 |

OTHER PUBLICATIONS

Japanese Office Action dated Dec. 15, 2009, issued in corresponding Japanese Application No. 2008-000756, with English translation.

*Primary Examiner* — Zelalem Eshete
(74) *Attorney, Agent, or Firm* — Nixon & Vanderhye PC

(57) ABSTRACT

A valve timing adjusting apparatus includes a first rotor, a second rotor, and a bias mechanism. The bias mechanism is provided to one of the first and second rotors. The bias mechanism includes a resilient member and a projection portion that is rotatable together with the one of the first and second rotors. The projection portion is rotatable relative to the other one of the rotors and contacts a contact part of the other one. Restoring force of the resilient member is applied to the other one of the first and second rotors through the projection portion. The contact part includes an inclination portion that is configured to increase and decrease restoring force of the resilient member.

10 Claims, 5 Drawing Sheets

FIG. 3A
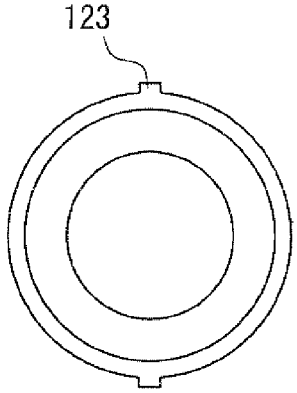
FIG. 3B
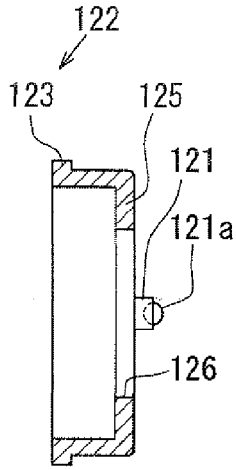
FIG. 3C
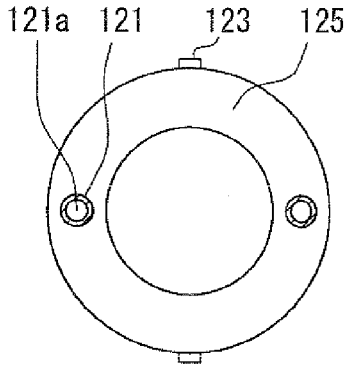
FIG. 4A
FIG. 4B
FIG. 4C
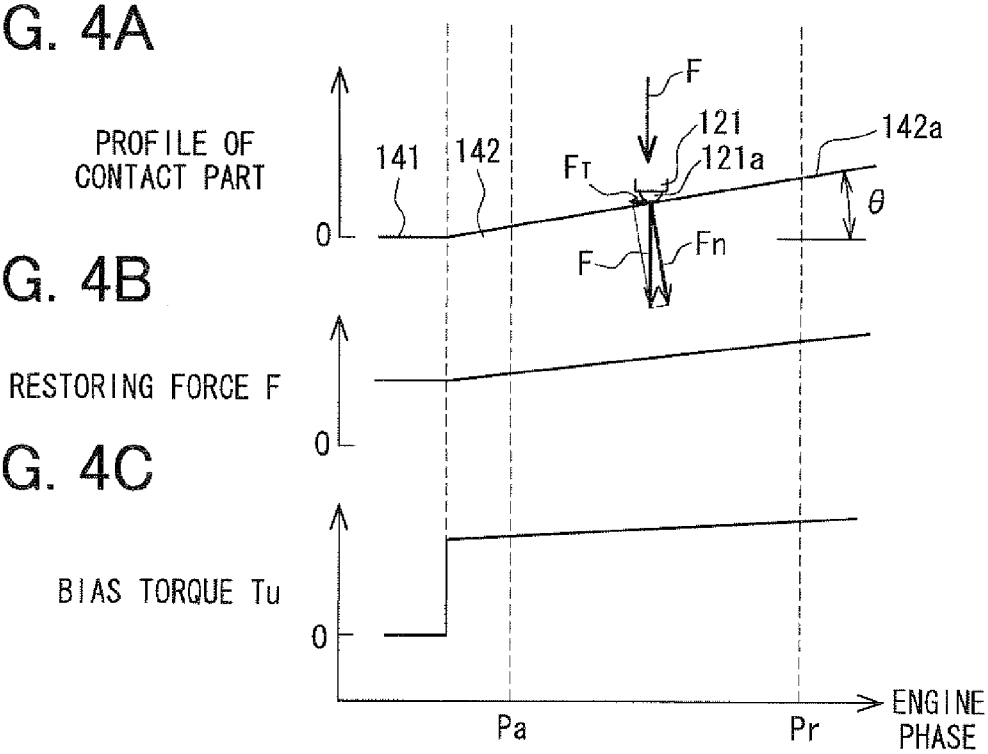

VALVE TIMING ADJUSTING APPARATUS

CROSS REFERENCE TO RELATED APPLICATION

This application is based on and incorporates herein by reference Japanese Patent Application No. 2008-756 filed on Jan. 7, 2008.

BACKGROUND OF THE INVENTION

1. Field of the Invention

The present invention relates to a valve timing adjusting apparatus for adjusting timing (valve timing) of opening and closing one of an intake valve and an exhaust valve of an internal combustion engine.

2. Description of Related Art

A conventional valve timing adjusting apparatus is known to includes a housing, which serves as a first rotor rotatable synchronously with a drive shaft, and a vane rotor, which serves as a second rotor rotatable synchronously with a driven shaft. In the above-type valve timing adjusting apparatus, the housing includes shoes, and the vane rotor includes vanes. An advance chamber and a retard chamber are defined between the shoe and the vane one after another in the rotational direction. When working fluid is supplied to the advance chamber or the retard chamber, the driven shaft is driven relative to the drive shaft in an advance direction or in a retard direction, respectively, in order to adjust valve timing of the valve (see JP-A-H11-294121, for example).

In the above valve timing adjusting apparatus, for example, as described in JP-A-H11-294121, the driven shaft receives variable torques (torque reversals) that periodically vary in a direction for advancing or retarding the driven shaft based on the rotation of the internal combustion engine. The variable torque is generated due to, for example, spring reaction force of a valve spring for the valve opened and closed by the driven shaft. Also, the variable torque is generated by drive reaction force from a mechanical pump in a case, where the mechanical pump is driven by the driven shaft.

In a valve timing adjusting apparatus that controls the engine phase in an advance direction during an event of starting the internal combustion engine that is applied with the above variable torque, for example, the valve timing adjusting apparatus is provided with a bias member that has bias torque set above average torque of the variable torque as shown in JP-A-H11-294121. The bias member assists biasing rotational torque that is generated when fluid is supplied to the advance chamber and the retard chamber. In the above conventional valve timing adjusting apparatus, the torque applied to the driven shaft, such as the variable torque, the rotational torque, and the bias torque of the bias member, is balanced such that the phase (engine phase) of the driven shaft relative to the drive shaft is determined.

A resilient member, such as a spring, may be employed as the bias member that assists the torque for urging the engine phase in the advance direction against the average torque of the variable torque applied to the driven shaft. In the above case, restoring force of the resilient member is used as the bias torque. For example, the bias member in the conventional technique employs a helical torsion spring (see JP-A-H11-294121), a spiral spring (see JP-A-2000-179314), or a compression spring provided in the an advance chamber (see WO01/55562). Each of the above springs in the conventional technique has one end that is movable together with a first rotor that is rotatable synchronously with the drive shaft. Also the above conventional spring has the other end movable together with a second rotor that is rotatable synchronously with the driven shaft. In other words, both ends of the above spring are integrally movable with the rotation of the first rotor and the second rotor, respectively. As a result, the following substantial design restriction may occur disadvantageously.

A cam angle phase is defined as the engine phase or a relative phase of the second rotor relative to the first rotor. For example, in a case, where a torsion angle of the helical torsion spring is increased in order to achieve torque required for shifting the cam angle phase, torsion angle may be excessively large such that the allowable stress of the spring is surpassed, and thereby durability of the spring may deteriorate.

Also, in a case, where the outer diameter of the helical torsion spring is increased in order to reduce stress of the spring, the spring is accordingly increased in size, and thereby the valve timing adjusting apparatus that is assembled with the spring is accordingly increased in size.

Thus, a method for increasing a cross-sectional area of a wire of the helical torsion spring may be employed in order to achieve the required torque. However, a spring constant of the spring is increased, and thereby bias torque required to achieve a change of unit of the cam angle phase (engine phase) is increased. In the valve timing adjusting apparatus, the above engine phase is adjusted to track or to follow the target phase in general. In a case for reducing a gap between the engine phase and the target phase, a change amount of bias torque that is required to reduce the gap may be substantially large, and thereby the controllability may deteriorate. Therefore, it may become more difficult to adjust the engine phase to the target phase accurately.

It should be noted that the number of the compression spring received in the advance chamber may be increased in order to achieve the required torque. However, similar to the above method for increasing the cross-sectional area of the wire, a total spring constant for the compression springs is accordingly increased. Also, in the above case, assembly of the compression springs in the advance chamber may become more complicated, and thereby the productivity may deteriorate disadvantageously. As a result, the valve timing adjusting apparatus may increase in manufacturing cost disadvantageously.

SUMMARY OF THE INVENTION

The present invention is made in view of the above disadvantages. Thus, it is an objective of the present invention to address at least one of the above disadvantages.

To achieve the objective of the present invention, there is provided a valve timing adjusting apparatus provided to a driving force transmission system that transmits driving force from a drive shaft of an internal combustion engine to a driven shaft that opens and closes at least one of an intake valve and an exhaust valve, wherein the valve timing adjusting apparatus adjusts timing of opening and closing the at least one of the intake and exhaust valves, wherein the valve timing adjusting apparatus includes a first rotor, a second rotor, and a bias mechanism. The first rotor is rotatable synchronously with the drive shaft. The second rotor is rotatable synchronously with the driven shaft. The second rotor and the first rotor define therebetween an advance chamber and a retard chamber that are arranged one after another in a rotational direction. The second rotor drives the driven shaft relative to the drive shaft in an advance direction when working fluid is supplied to the advance chamber. The second rotor drives the driven shaft relative to the drive shaft in a retard direction when working fluid is supplied to the retard chamber. The bias mechanism is provided to one of the first and second rotors. The bias mechanism includes a resilient member and a projection portion. The projection portion is rotatable together with the one of the first and second rotors. The projection portion is rotatable relative to the other one of the first and second rotors and contacts a contact part of the other one of the first and second rotors. The resilient member and the projection portion are arranged such that restoring force of the resilient member is applied to the other one of the first and second rotors through the projection portion. The contact part of the other one of the first and second rotors includes an inclination portion that is opposed to the projection portion. The inclination portion is configured to increase and decrease restoring force of the resilient member.

BRIEF DESCRIPTION OF THE DRAWINGS

The invention, together with additional objectives, features and advantages thereof, will be best understood from the following description, the appended claims and the accompanying drawings in which:

FIG. 3A is a side view illustrating a support shaft portion in FIG. 1 observed in direction III;

FIG. 3B is a cross-sectional view of the support shaft portion;

FIG. 3C is a side view of the support shaft portion;

FIG. 4A is a characteristic diagram illustrating a profile of a contact part of a bias mechanism according to the valve timing adjusting apparatus in FIG. 1;

FIG. 4B is a characteristic diagram illustrating a restoring force (bias load) of a resilient member of the bias mechanism;

FIG. 4C is a characteristic diagram illustrating a bias torque of the bias mechanism;

FIG. 7B is a characteristic diagram illustrating a restoring force (bias load) of a resilient member of the bias mechanism according to the second embodiment;

FIG. 7C is a characteristic diagram illustrating a bias torque of the bias mechanism according to the second embodiment;

FIG. 8B is a characteristic diagram illustrating a restoring force (bias load) of a resilient member of the bias mechanism according to the third embodiment; and FIG. 8C is a characteristic diagram illustrating a bias torque of the bias mechanism according to the third embodiment.

DETAILED DESCRIPTION OF PREFERRED EMBODIMENTS

The present invention will be described with multiple embodiments with reference to accompanying drawings. In each of the embodiments, a corresponding component is indicated by the same numeral, and thereby overlapped explanation will be omitted.

First Embodiment

Figure 1:
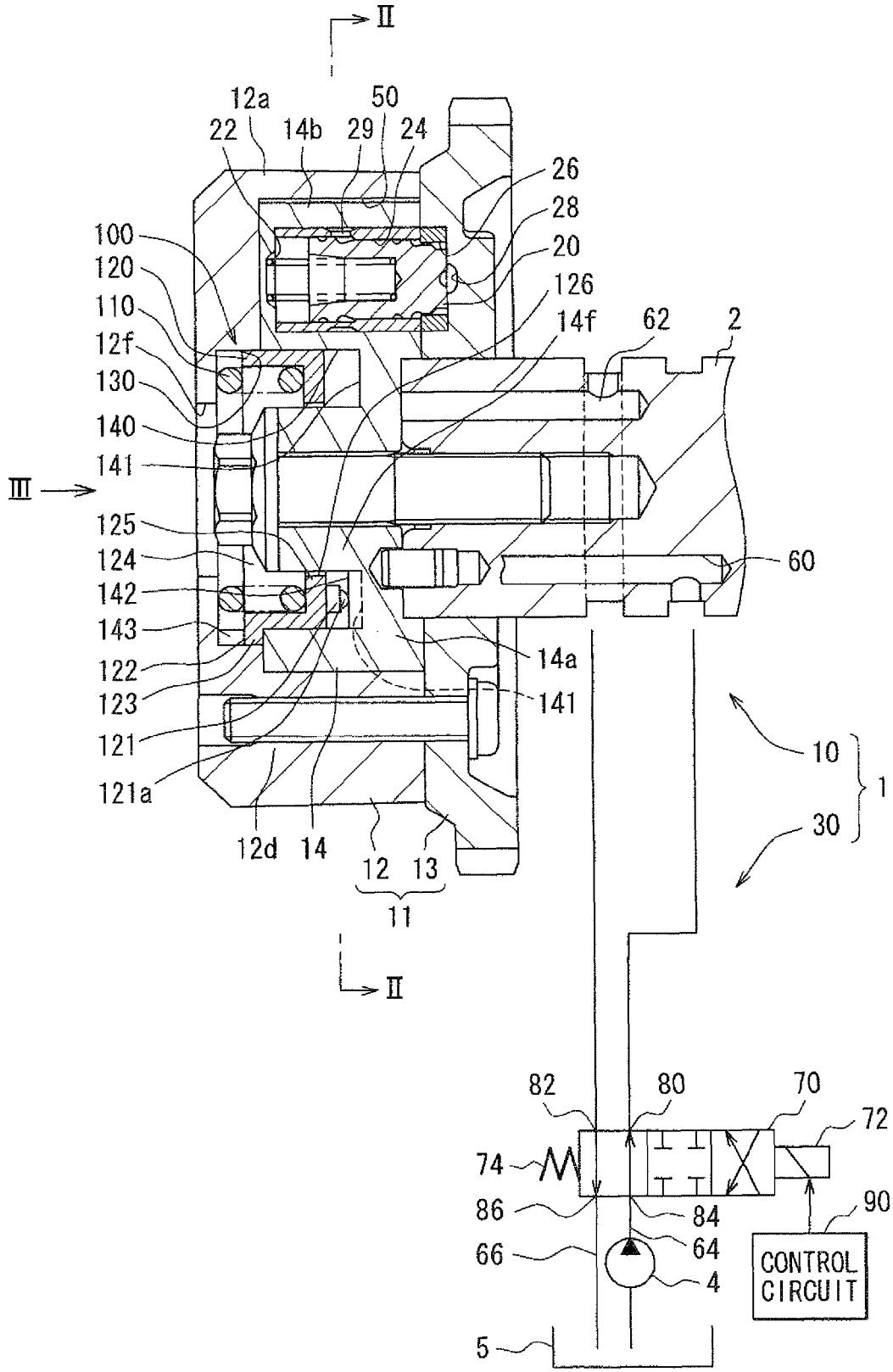
FIG. 1 is a configuration diagram illustrating a valve timing adjusting apparatus according to the first embodiment of the present invention.

FIG. 1 shows an example, in which a valve timing adjusting apparatus 1 according to one embodiment of the present invention is applied to an internal combustion engine of a vehicle. The valve timing adjusting apparatus 1 is a hydraulic valve timing adjusting apparatus employing hydraulic oil that serves as "working fluid", and the valve timing adjusting apparatus 1 adjusts valve timing of an exhaust valve that serves as a "valve".

(Basic Configuration)

Hereinbelow, basic components of the valve timing control apparatus 1 will be described. The valve timing control apparatus 1 has a drive unit 10 and a control unit 30. The drive unit 10 is provided in a driving force transmission system that transmits driving force of a crankshaft (not shown) of the internal combustion engine to a camshaft 2 of the internal combustion engine, and the drive unit 10 is driven with the hydraulic oil. The control unit 30 controls supply of the hydraulic oil to the drive unit 10. In the present embodiment, the crankshaft serves as a "drive shaft", and the camshaft 2 serves as a "driven shaft".

(Drive Unit)

Figure 2:
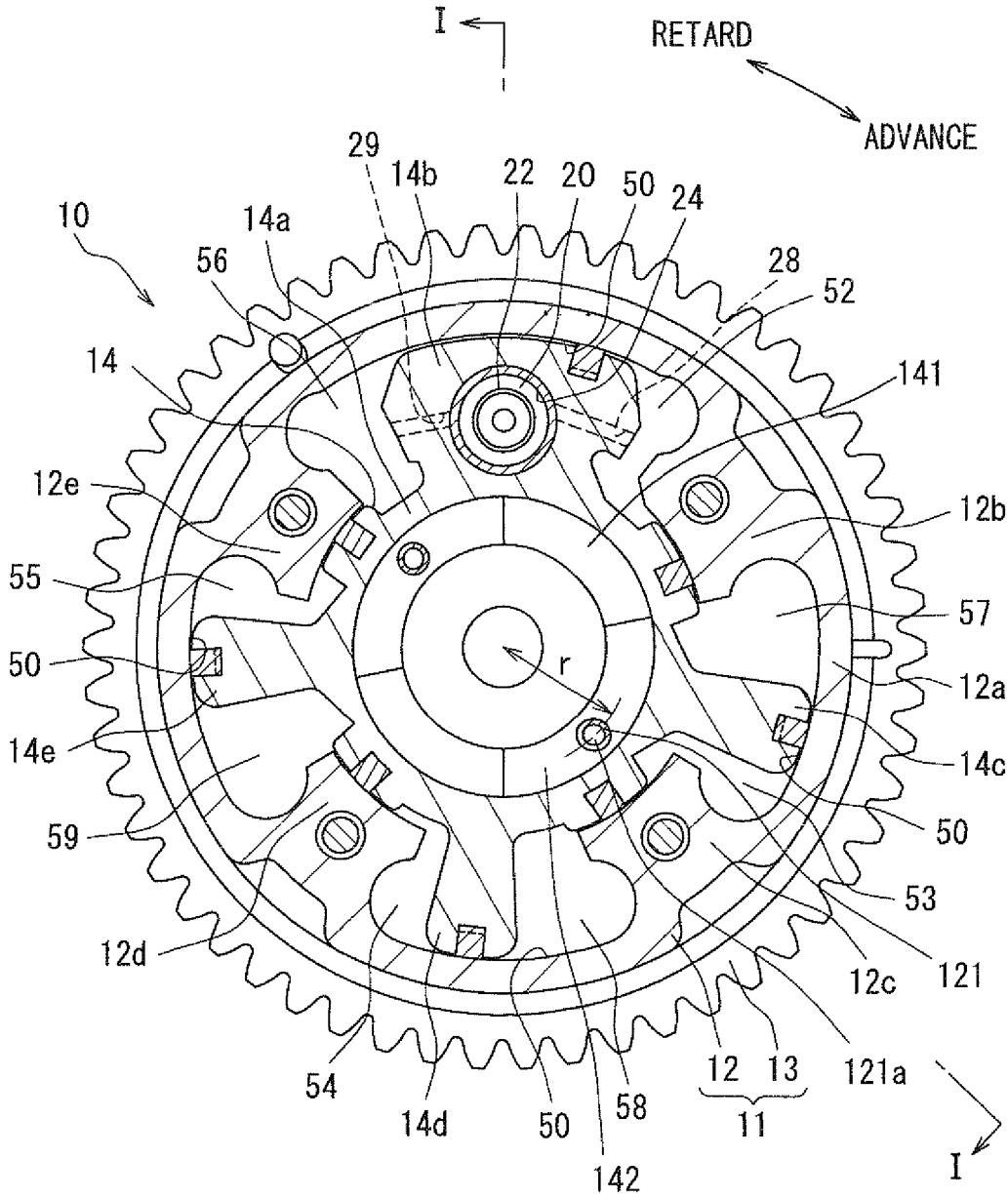
FIG. 2 is a cross-sectional view taken along line II-II in FIG. 1.

As shown in FIGS. 1, 2, the drive unit 10 includes a housing 11, which serves as a "first rotor", and a vane rotor 14, which serves as a "second rotor". The housing 11 includes a shoe housing 12 and a sprocket 13.

The shoe housing 12 is made of metal and includes a tubular portion 12*a* and multiple shoes 12*b*, 12*c*, 12*d*, 12*e*. The tubular portion 12*a* has a hollow cylindrical shape with a bottom, and the shoes 12*b*, 12*c*, 12*d*, 12*e* serves as a partitioning part.

The respective shoes 12*b* to 12*e* are arranged in the tubular portion 12*a* at positions at approximately equal intervals in the rotation direction and projected inwardly in a radial direction from above arranged positions. A radially inward surface of each of the shoes 12*b* to 12*e* has an arcuate recess shape in section viewed in an axial direction of the housing 11, and the radially inward surface is in slide-contact with an outer peripheral wall surface of a hub portion 14*a* of the vane rotor 14. Each chamber 50 is respectively defined between adjacent ones of the shoes 12*b* to 12*e*, which are arranged adjacent to each other in the rotation direction.

The sprocket 13 is made of metal and has a circular plate shape. The sprocket 13 is coaxially fixed to an opening side of the tubular portion 12*a* through a bolt. The sprocket 13 is connected with the crankshaft through a timing chain (not shown). Due to the above structure, during the operation of the internal combustion engine, the driving force is transmitted from the crankshaft to the sprocket 13 such that the housing 11 is rotated synchronously with the crankshaft clockwise in FIG. 2.

The housing 11 coaxially receives therein the vane rotor 14, and the vane rotor 14 has opposite longitudinal end surfaces that are slidable with a bottom wall surface of the tubular portion 12*a* and with an internal wall surface of the sprocket 13, respectively. The vane rotor 14 is made of metal and includes the hub portion 14*a*, which has a cylindrical shape, and multiple vanes 14*b*, 14*c*, 14*d*, 14*e* projecting from the hub portion 14*a*.

The hub portion 14*a* is coaxially fixed with the camshaft 2 through a bolt. In this arrangement, the vane rotor 14 is synchronously rotated with the camshaft 2 in the clockwise direction in FIG. 2 and is relatively rotatable with respect to the housing 11.

The vanes 14*b* to 14*e* are arranged at positions of the hub portion 14*a* at approximately equal intervals in the rotation direction and project outwardly in the radial direction from the above positions. The vanes 14*b* to 14*d* are accommodated in the corresponding chambers 50. The radially outward surface of each of the vanes 14*b* to 14*d* has an arcuate projecting shape in section viewed in the axial direction of the housing 11 as shown in FIG. 2, and the radially outward surface is in slide-contact with an inner peripheral wall surface of the tubular portion 12*a*.

Each of vanes 14*b* to 14*d* and the housing 11 define therebetween an advance chamber and a retard chamber by partitioning the corresponding chamber 50 into halves in the rotation direction. More particularly, a retard chamber 52 is defined between the shoe 12*b* and the vane 14*b*, a retard chamber 53 is defined between the shoe 12*c* and the vane 14*c*, a retard chamber 54 is defined between the shoe 12*d* and the vane 14*d*, and a retard chamber 55 is defined between the shoe 12*e* and the vane 14*e*. Also, an advance chamber 56 is defined between the shoe 12*e* and the vane 14*b*, an advance chamber 57 is defined between the shoe 12*b* and the vane 14*c*, an advance chamber 58 is defined between the shoe 12*c* and the vane 14*d*, and an advance chamber 59 is defined between the shoe 12*d* and the vane 14*e*.

In the above drive unit 10, when hydraulic oil is supplied to each of the advance chambers 56 to 59, the vane rotor 14 rotates with respect to the housing 11 in an advance direction, and a phase of the camshaft 2 with respect to the crankshaft, or an engine phase that determines valve timing, is shifted in the advance direction. Then, each of the vanes 14*b* to 14*e* is brought into contact with the corresponding adjacent shoe 12*b* to 12*e* on the advance side of the vane, and thereby a rotational position of the vane rotor 14 relative to the housing 11 becomes a full advance position. In other words, the vane rotor 14 is fully advanced relative to the housing 11. Thus, the engine phase becomes a full advance phase.

In contrast, in the drive unit 10, when hydraulic oil is supplied to each of the retard chambers 52 to 55, the vane rotor 14 rotates with respect to the housing 11 in a retard direction, and the engine phase is shifted in the retard direction. Then, when the vane 14*b* is brought into contact with the shoe 12*e* that is positioned on a retard side of the vane 14*b*, the rotational position of the vane rotor 14 relative to the housing 11 becomes a full retard position. In otherwords, the vane rotor 14 is fully retarded relative to the housing 11. Thus, the engine phase becomes a full retard phase.

It should be noted that the rotational position of the vane rotor 14 relative to the housing 11 shown in FIGS. 1, 2 is an intermediate position, where the internal combustion engine is allowed to be started. Also, when the rotational position of the vane rotor 14 corresponds to the above intermediate position, the engine phase becomes an intermediate phase that is suitable for improving fuel efficiency. The relative rotational position between the rotors 11, 14, which is shown in FIG. 1, 2, is defined as "start intermediate position", and the engine phase caused by the above relative rotational position is defined as "start intermediate phase" in the present embodiment. The engine phase in the event of starting the internal combustion engine is not limited to the start intermediate phase, and may be alternatively set as the above full advance phase. Thus, the engine phase in the event of starting is limited to one of the start intermediate phase and the full advance phase by using a lock pin 20 and the like.

As shown in FIGS. 1, 2, the drive unit 10 is further provided with the lock pin 20 that serves as "lock member" and a bias member 22.

The lock pin 20 is made of metal and has a cylindrical column shape. The lock pin 20 is always fitted with a receiving hole 24. The receiving hole 24 is configured to open to an end surface of the vane 14*b* toward the sprocket 13 and has a bottom. In the above fitting condition, the lock pin 20 is displaceable linearly and reciprocably in a longitudinal direction that is parallel with a rotational axis of the vane rotor 14.

The bias member 22 is made of a compression coil spring and is provided in the receiving hole 24 between the bottom of the receiving hole 24 and the lock pin 20. The bias member 22 is elastically deformable toward a compressed side, and generates a restoring force that biases the lock pin 20 toward the sprocket 13.

The lock pin 20 receives the restoring force as above, and is fittable with a fitting hole 26 defined at the internal wall surface of the sprocket 13 when the lock pin 20 is displaced toward the sprocket 13 while the lock pin 20 is fitted with the receiving hole 24 in the start intermediate phase (start intermediate position). Thus, when the lock pin 20 is fitted with the fitting hole 26, the lock pin 20 locks the vane rotor 14 relative to the housing 11, and thereby prohibits rotation of the vane rotor 14 and the housing 11 relative to each other.

The fitting hole 26 is communicated with a retard chamber 52 through a retard flow channel 28. Thus, the lock pin 20 that is fitted into the fitting hole 26 receives pressure of hydraulic oil that is supplied to the fitting hole 26 through the retard chamber 52 and the retard flow channel 28. As a result, the lock pin 20 is pressed toward the bias member 22. Also, the receiving hole 24 is communicated with an advance chamber 56 through an advance flow channel 29. Thus, the lock pin 20 that is fitted with the fitting hole 26 receives pressure of hydraulic oil that is supplied to the receiving hole 24 through the advance chamber 56 and the advance flow channel 29, and thereby is pressed toward the bias member 22.

As above, when the lock pin 20 fitted with the fitting hole 26 receives pressure of oil supplied to at least one of the holes 26, 24, the lock pin 20 is displaced such that the lock pin 20 is able to be detached from or disengaged from the fitting hole 26. In the above, when the lock pin 20 is disengaged from the fitting hole 26, the locked state for prohibiting the vane rotor 14 relative to the housing 11 is unlocked, and thereby the relative rotation of the vane rotor 14 and the housing 11 is enabled.

(Control Unit)

In the control unit 30 shown in FIG. 1, an advance flow channel 60 is provided to extend through the camshaft 2 and a journal bearing (not shown) that journals the camshaft 2, and the advance flow channel 60 is communicated with the advance chambers 56 to 59. A retard flow channel 62 is also provided to extend through the camshaft 2 and the journal bearing and is communicated with the retard chamber 52 to 55.

A supply flow channel 64 is provided to communicate with a discharge port of a pump 4 that serves as a "fluid supplier", and a drain flow channel 66 is provided to drain hydraulic oil to an oil pan 5 that is provided on an inlet port side of the pump 4. Thus, the pump 4 pumps and supplies hydraulic oil, which is pumped up from the oil pan 5, to the supply flow channel 64. The pump 4 of the present embodiment is a mechanical pump that is driven by the crankshaft such that the pump operates synchronously with an operation of the internal combustion engine. In other words, supply of hydraulic oil from the pump 4 is initiated by the starting of the internal combustion engine, and supply of hydraulic oil is continued during the operation of the internal combustion engine. Then, supply of hydraulic oil is stopped when the internal combustion engine is stopped. Therefore, pressure of hydraulic oil supplied from the pump 4 in the event of starting and stopping of the internal combustion engine is lower than pressure hydraulic oil during the operation of the internal combustion engine.

A control valve 70 is a spool valve that actuates a spool using an electromagnetic driving force generated by a solenoid 72 and a restoring force generated by a return spring 74. The control valve 70 includes an advance port 80, a retard port 82, a supply port 84, and a drain port 86. The advance port 80 is communicated with the advance flow channel 60, and the retard port 82 is communicated with the retard flow channel 62. Also, the supply port 84 is communicated with the supply flow channel 64 and is supplied with hydraulic oil from the pump 4. The drain port 86 is communicated with the drain flow channel 66 in order to drain hydraulic oil. The control valve 70 operates based on the energization of the solenoid 72 and controls a connection state of each of the supply port 84 and the drain port 86 with a corresponding one of the advance port 80 and the retard port 82.

A control circuit 90 includes, for example, a microcomputer and is electrically connected with the solenoid 72 of the control valve 70. The control circuit 90 controls energization to the solenoid 72 and controls the operation of the internal combustion engine.

In the above control unit 30, the control valve 70 is operated according to energization to the solenoid 72, which is controlled by the control circuit 90, and accordingly controls the connection state of the ports 84, 86 with the ports 80, 82. Specifically, when the supply port 84 is connected with the advance port 80, and the drain port 86 is connected with the retard port 82, hydraulic oil supplied from the pump 4 is supplied to each of the the advance chambers 56 to 59 through flow channels 64, 60. Also, hydraulic oil in each of the retard chambers 52 to 55 is drained to the oil pan 5 through flow channels 62, 66. In contrast, when the supply port 84 is connected with the retard port 82, and the drain port 86 is connected with the advance port 80, hydraulic oil supplied from the pump 4 is supplied to each of the retard chambers 52 to 55 through the flow channels 64, 62. Also, hydraulic oil in each of the advance chambers 56 to 59 is supplied to the oil pan 5 through the flow channels 60, 66.

As above, the drive unit 10 and the control unit 30 of the valve timing adjusting apparatus 1 have been described. A characteristic configuration of the valve timing adjusting apparatus 1 will be described below.

(Characteristic Configuration)

As shown in FIGS. 1, 3A to 4C, in the present embodiment, the drive unit 10 includes a bias mechanism 100. The bias mechanism 100 includes a resilient member 110, a bush 120 serving as a "support shaft portion", and contact parts 142, each of which converts "restoring force" into "bias torque". In the above configuration, the bias mechanism 100 is configured to apply "restoring force" generated by the resilient member 110 to the housing 11 as "bias torque" that biases the housing 11 to rotate relative to the vane rotor 14 in an advance direction. In other words, the bias mechanism 100 applies the bias torque, which is converted from restoring force, to the housing 11 such that the housing 11 is rotated relative to the vane rotor 14 in the advance direction.

The tubular portion 12*a* of the housing 11 includes an opening part 12*f* at the bottom of the tubular portion 12*a*, and the opening part 12*f* is open to an exterior of the housing 11. The tubular portion 12*a* includes a support hole 130 (first support hole) at the bottom thereof and the first support hole 130 opens to an end surface of the bottom of the tubular portion 12*a* opposite from the opening part 12*f*. The first support hole 130 receives therein one axial end portion of the resilient member 110 that generates restoring force, and defines therein a part of a receiving chamber 124. The support hole 130 includes a bottom portion provided between the support hole 130 and the opening part 12*f*, and the bottom portion contacts the one axial end portion of the resilient member 110 such that the bottom portion limits the resilient member 110 from displacing in a longitudinal direction.

The bush 120 is made of metal and has a hollow cylindrical shape. The bush 120 is fitted coaxially with the tubular portion 12*a* of the shoe housing 12 and the hub portion 14*a* of the vane rotor 14. The bush 120 supports the first support hole 130 of the tubular portion 12*a* and a second support hole 140 of the hub portion 14*a* from radially inner sides of the first and second support holes 130, 140, for example.

The bush 120 and the first support hole 130 are displaceable relative to each other in the longitudinal direction, and a lock portion 122 causes the bush 120 and the first support hole 130 to rotate integrally with each other. In other words, the lock portion 122 limits the bush 120 and the first support hole 130 from rotating independently relative to each other. The lock portion 122 includes a pair of engaging protrusions 123 and engaging grooves 143, and the engaging protrusions 123 project from the bush 120 in opposite radial directions as shown in FIG. 3. Also, each of the engaging grooves 143 is a recess that is engaged with the corresponding engaging protrusion 123.

The bush 120 and the second support hole 140 are displaceable relative to each other in the longitudinal direction, and the bush 120 and the second support hole 140 are rotatable relative to each other. The second support hole 140 includes the contact parts 142 at a bottom portion 141, and the contact parts 142 and the bottom portion 141 are provided between an inner periphery of the second support hole 140 and an outer periphery of a fixation portion 14*f* of the hub portion 14*a*.

The bush 120 includes a bottom portion 125 at an end portion of the hollow cylindrical body opposite from the engaging protrusion 123, and the bottom portion 125 contacts the other axial end portion of the resilient member 110, and the resilient member 110 is interposed between the bottom portion of the first support hole 130 and the bottom portion 125 in the longitudinal direction such that restoring force of the resilient member 110 is generated.

Also, the bottom portion 125 includes an insertion hole 126 that opens to receive therein the fixation portion 14*f* arranged coaxially with the second support hole 140 of the hub portion 14*a*.

Also, the bottom portion 125 further includes projection portions 121 on a side of the bottom portion 125 opposite from the receiving chamber 124, and the projection portions 121 contact the respective contact parts 142. Each of the projection portions 121 includes a ball 121*a* serving as a "rolling element", and the projection portion 121 slidably contacts the contact part 142 through the ball 121*a*.

As shown in FIG. 2, each of the contact parts 142 has an arcuate shape that is arranged in a circumferential direction of the bottom portion 141 having a circular ring shape, and the contact parts 142 are located at positions correspondingly to the two projection portions 121 of the bush 120. The contact part 142 includes an inclination portion 142*a* having an inclined surface shape, and the inclination portion 142*a* is arranged correspondingly at least within a phase adjustment range of the engine phase as shown in FIG. 4A. In the above, the phase adjustment range corresponds to an angular range between a full advance phase Pa to a full retard phase Pr.

Figure 5:
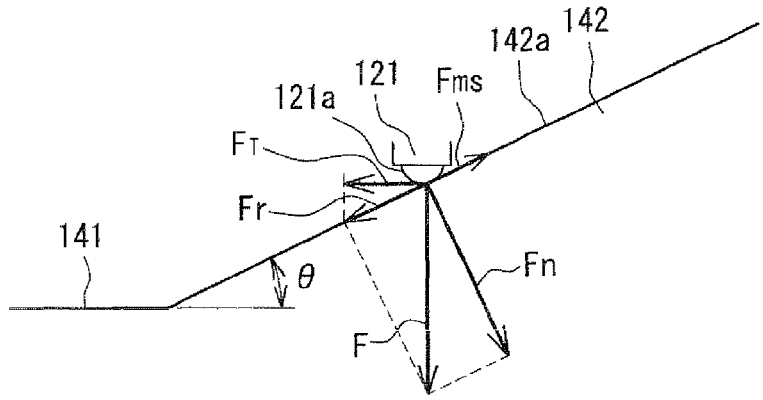
FIG. 5 is a schematic diagram for explaining conversion of restoring force into bias torque by the bias mechanism in FIG. 1.

The inclination portion of the contact part 142 has an inclined surface that is angled relative to the bottom portion 141 by a predetermined inclination angle θ as shown in FIGS. 4A, 5, and the inclined surface is configured to be angled such that restoring force of the resilient member 110 is increased as a function of the phase accordingly based on a change of the phase from the full advance phase Pa to the full retard phase Pr. In other words, the inclined surface is formed to be away from a plane of the bottom portion 141 toward the full retard phase Pr. The inclination portion of the contact part 142 causes restoring force of the resilient member 110 to act as bias torque (assisting torque) that preadvances the engine phase toward the full advance phase during the stop of the internal combustion engine in order to prepare the starting in the next operation of the engine. In the above, the engine phase corresponds to the phase of the vane rotor 14 relative to the housing 11.

As shown in FIG. 1, the resilient member 110 is made of a compression spring, and compression load is formed in the longitudinal direction of the compression spring. As a result, magnitude of the load, or magnitude of the restoring force, is defined in accordance with a deformation amount of the spring that is compressed in the longitudinal direction. Thus, the deformation amount of the resilient member 110 is determined based on a lift amount of the contact part 142 (see FIG. 4A). In FIG. 4A, the lift amount corresponds to a dimension measured between an extended plane of the bottom portion 141 and the inclination portion 142*a* of the contact part 142, for example.

It should be noted that in the present embodiment, a set load of the resilient member 110 is determined at a magnitude that overcomes average torque caused by variable torque applied through the camshaft 2. In the above, variable torque is applied to bias the vane rotor 14 relative to the housing 11 alternately in the advance direction and the retard direction, for example.

The characteristic configuration of the valve timing adjusting apparatus 1 has been described. The variable torque applied to the drive unit 10 will be described below.

(Variable Torque)

Figure 6:
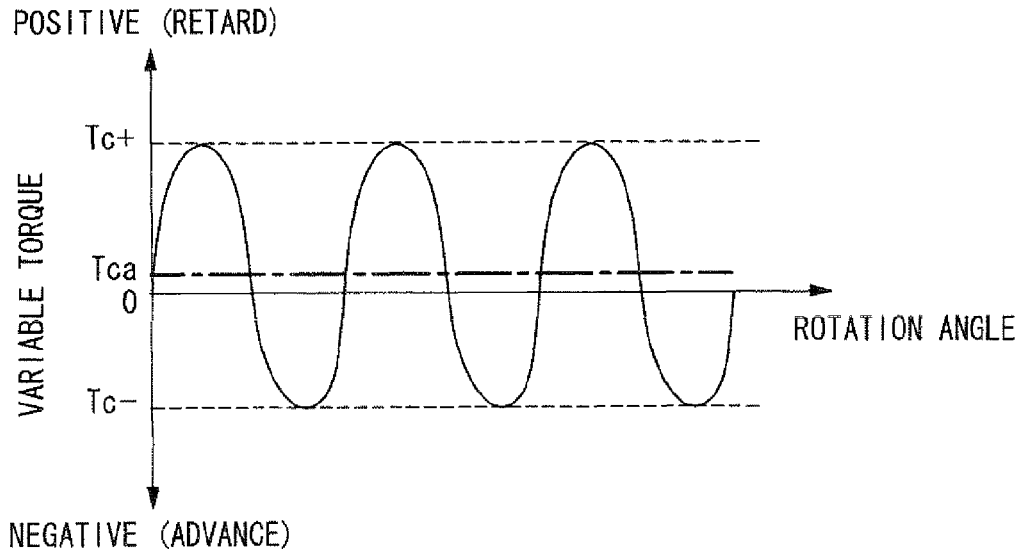
FIG. 6 is a schematic diagram for explaining variable torque.

During an operation of the internal combustion engine, variable torque is applied to the camshaft 2 and the vane rotor 14 in accordance with spring reaction force and drive reaction force. The spring reaction force is caused by a valve spring of the exhaust valve that is opened and closed by the camshaft 2, and the drive reaction force is caused by a fuel injection pump that is driven by the camshaft 2. As illustrated in FIG. 6, variable torque periodically varies between a positive torque and a negative torque. The positive torque is applied in a direction to retard the engine phase of the camshaft 2 relative to the crankshaft, and the negative torque is applied in a direction to advance the engine phase. Also, specifically, friction is generated between the camshaft 2 and the journal bearing (not shown) that journals the camshaft 2. As a result, the variable torque of the present embodiment has a characteristic, in which a peak torque Tc+ of the positive torque is greater in absolute value than a peak torque Tc− of the negative torque. Thereby, an average torque Tca of the variable torque or "average variable torque" Tca is urged or biased in the direction of the positive torque in the present embodiment. In other words, the average variable torque Tca is biased in the positive direction (retard direction) opposite from a direction, in which bias torque Ts of the assist spring 22 (bias member) acts. The average variable torque Tca is increased accordingly to the increase of the rotational speed of the internal combustion engine.

The variable torque applied to the drive unit 10 has been described. The characteristic operation of the valve timing adjusting apparatus 1 will be described.

(Characteristic Operation)

Characteristic operation of the valve timing adjusting apparatus 1 will be described with reference to FIGS. 2, 4A to 5. It should be noted that in order to facilitate the explanation, FIGS. 4A to 5 show the projection portion 121 of the bias mechanism 100 that integrally rotatable with the housing 11, and other components other than the projection portion 121 are omitted in FIGS. 4A to 5. Also, the inclination angle θ of the inclined surface of the contact part 142 in FIG. 5 is schematically enlarged compared with that shown in FIG. 4A for facilitating the explanation thereof.

In the above bias mechanism 100, the projection portion 121 of the bias mechanism 100 always contacts the contact part 142. Because the resilient member 110 presses inclination portion (profile) of the contact part 142 through the projection portion 121 as shown in FIG. 4A, restoring force F generated by the resilient member 110 has load characteristic shown in FIG. 4B. The restoring force F forms a biasing force (normal direction biasing force) Fn and a component force (rotation component force) $F_T$. The normal direction biasing force Fn is applied in a direction normal to a contact surface of the contact part 142, and the rotation component force $F_T$ corresponds to a component of the normal direction biasing force Fn in the rotational direction. The normal direction biasing force Fn is expressed as F×cos θ in accordance with inclination angle θ of the contact part 142. The rotation component force $F_T$ is expressed as an equation of $F_T$=Fr×cos θ=F×sin θ×cos θ, where force Fr represents a paired component force in the inclined surface direction, which is paired with the normal direction biasing force Fn of the restoring force F. It should be noted that inclination angle θ defines characteristic (profile) of the inclination portion 142*a* of the contact part 142.

The bias torque Tu is defined as an equation of Tu=$F_T$×r, where an interaxial distance measured between the rotation center axis of both the rotors 11, 14 and an axis of the projection portion 121 is defined as r as shown in FIG. 2.

The bias torque Tu is determined based on the restoring force F of the resilient member 110, the profile of the contact part 142, and the interaxial distance r. Also, a change rate of the bias torque Tu as a function of the engine phase is determined based on the inclination angle θ of the contact part 142 and a spring constant of the resilient member 110. In the above bias mechanism 100, it is possible to keep the change rate of the bias torque Tu as a function of the engine phase relatively lower as a small change rate shown in FIG. 4C, and thereby the engine phase is effectively accurately adjusted to a target phase.

The adjustment of the engine phase of the valve timing adjusting apparatus 1 is made based on a balance between variable torque applied to the camshaft 2, the rotational torque, and a bias torque. The rotational torque is generated by advance supply (advance supply operation), which corresponds to supply of oil to the advance chambers 56 to 59, and retard supply (retard supply operation), which corresponds to supply of oil to the retard chamber 52 to 55. The bias torque is generated by the bias mechanism 100. In an adjustment method for adjusting the engine phase by adjusting the above defined rotational torque, control of the above advance supply and retard supply is performed to set the bias torque Tu in a magnitude that suppress the average variable torque. Also, the change rate of the bias torque Tu as a function of the engine phase is made substantially small, for example.

In a conventional art, a deformation amount (contraction amount) of the resilient member is directly defined by a change amount of the engine phase, or the relative phase between both the rotors. In the above, the deformation amount is associated with the restoring force of the resilient member. However, according to the resilient member 110 of the bias mechanism 100 of the present embodiment, a deformation amount (contraction amount) of the resilient member 110 is not directly defined by a change amount of the relative phase between both the rotors 11, 14. As a result, regardless of magnitude of the change of the relative phase between both the rotors 11, 14, the deformation amount of the resilient member 110, which corresponds to the above relative phase (engine phase), is able to be made smaller. Therefore, durability of the resilient member 110 of the bias mechanism 100 is effectively improved.

Thus, the valve timing adjusting apparatus 1 having the above bias mechanism 100 enables the accurate adjustment of the engine phase of the camshaft 2 relative to the crankshaft to the target phase, and also enables the durability.

Also, in a case, where the projection portion 121 displaces along the inclined surface of the contact part 142, frictional force Fms that is applied to the projection portion 121 is defined as an equation of $Fms=\mu\times Fn=\mu\times F\times\cos\theta$, where friction coefficient determined by a condition of contact between the contact part 142 and the projection portion 121 is defined as $\mu$. When the force Fr in the inclined surface direction exceeds frictional force Fms, the projection portion 121 is displaced along the inclined surface of the contact part 142.

Because the projection portion 121 includes the ball 121*a* that rolls on the contact part 142 as above, friction coefficient is able to be made substantially small in a state, where the contact part 142 contacts the projection portion 121, and thereby the projection portion 121 is smoothly movable along the inclined surface of the contact part 142. As a result, restoring force F that forms the bias torque Tu is limited from being wasted or reduced by frictional force.

(In the Event of Stopping and Starting the Engine)

During the operation of the internal combustion engine before stopping the engine, by making rotational speed of the internal combustion engine equal to or greater than a predetermined idle rotational speed Ni, pressure of hydraulic oil supplied from the pump 4 becomes equal to or greater than a predetermined threshold pressure P. In contrast, when the internal combustion engine is stopped in response to the stop command, such as turning off of the ignition switch, rotational speed of the internal combustion engine is reduced below the idle rotational speed Ni, and thereby pressure of supplied oil supplied from the pump 4 that is driven by the crankshaft is reduced below the threshold pressure P. As a result, in the drive unit 10, the bias torque Tu, which biases the vane rotor 14, caused by restoring force F of the resilient member 110 of the bias mechanism 100 is more dominant than force applied to the vane rotor 14 caused by pressure of oil supplied to the advance chambers 56 to 59 or the retard chamber 52 to 55. As a result, the vane rotor 14 biased by the bias mechanism 100 is biased or urged in the advance direction beyond the full retard position relative to the bush 120 that integrally rotates with the housing 11.

Because the above bias torque of the bias mechanism 100 assists or increases the torque that causes the relative rotation in the advance direction, it is possible to relatively rotate the vane rotor 14 to the certain engine position, at which the lock pin 20 is fitted into the fitting hole 26. In other words, it is possible to relatively rotate the vane rotor 14 to the start intermediate phase or the full advance phase, which is defined by the fitting of the lock pin 20 and the fitting hole 26. It should be noted that in the above case, the lock pin 20 is made displaceable toward the sprocket 13 in response to the event, where pressure of oil supplied from the pump 4 becomes lower than the threshold pressure P. Thus, the vane rotor 14 that is held at the start intermediate phase or at the full advance phase is easily locked to the housing 11 by the fitting of the lock pin 20 into the fitting hole 26. As a result, after the stopping of the internal combustion engine, it is possible to hold the engine phase at the start intermediate phase or at the full advance phase such that the engine phase is readily positioned for the next starting of the internal combustion engine.

After the above, in the event of starting the internal combustion engine in response to a start command, such as turning on of the ignition switch, pressure of hydraulic oil supplied from the pump 4 remains below the threshold pressure P until the internal combustion engine becomes able to rotate without the assist of the starter (or until the engine completely operates). Thus, due to the principles similar to the above case of stopping of the engine, the relative rotational position of the vane rotor 14 relative to the housing 11 is held and locked at the start intermediate phase or at the full advance phase. As a result, even when the camshaft 2 receives variable torque, the engine phase is able to be held at the start intermediate phase or the full advance phase.

(During Operation)

During the operation of the internal combustion engine after the event of starting the engine, pressure of hydraulic oil supplied from the pump 4 is kept above the threshold pressure P. Due to the above, in the drive unit 10, the force applied to the vane rotor 14 caused by pressure of oil supplied to the advance chambers 56 to 59 or the retard chamber 52 to 55 is more dominant than the bias torque Tu, which biases the vane rotor 14, caused by the restoring force F of the resilient member 110 of the bias mechanism 100. Accordingly, the control circuit 90 controls the control valve 70 to supply hydraulic oil to at least one of the advance chambers 56 to 59 or the retard chamber 52 to 55 such that the lock pin 20 is displaced toward the bias member 22, and thereby the lock state of the vane rotor 14 to the housing 11 is unlocked.

In a case, where the control circuit 90 controls the control valve 70 to supply hydraulic oil to the advance chambers 56 to 59 after unlocking the vane rotor 14, the vane rotor 14 is rotated relative to the bush 120 or the housing 11 in the advance direction. Also, in another case, where the control circuit 90 controls the control valve 70 to supply hydraulic oil to the retard chamber 52 to 55 after unlocking the vane rotor 14, the vane rotor 14 is rotated relative to the housing 11 in the retard direction.

In the above case, the change rate of the bias torque Tu relative to the engine phase caused by the bias mechanism 100 is suppressed to be substantially small. Thus, in a case, where the rotational torque, the average variable torque, and the bias torque are balanced with each other by controlling the advance supply operation and retard supply operation in order to generate the rotational torque, the control unit 30 is enabled to easily control the advance supply operation and retard supply operation. As a result, the engine phase is accurately adjusted to the target phase.

In the present embodiment, the bias mechanism 100 includes the resilient member 110 that generates "restoring force", the bush 120 serving as "support shaft portion", and the contact part 142 that converts "restoring force" into "bias torque". In both the rotors 11, 14, the bush 120 supports the first receiving hole 130 of the tubular portion 12*a* and the second support hole 140 of the hub portion 14*a* from the radially inner sides of the first and second support holes 130, 140, for example. In the housing 11, the bush 120 is configured to be immovable relative to the tubular portion 12*a* of the shoe housing 12, and the resilient member 110 is interposed between the shoe housing 12 and the bush 120. In the above configuration, the resilient member 110 is compressed in the longitudinal direction and generates restoring force F. Also, the vane rotor 14 is configured such that the bush 120 is slidable relative to the vane rotor 14 in the longitudinal direction, and such that the projection portion 121 of the bush 120 is provided to the contact part 142 at the bottom portion 141 of the vane rotor 14.

In the above configuration, when the relative phase between both the rotors 11, 14 is shifted in the advance direction or in the retard direction, the bias mechanism 100 rotates integrally with the housing 11, and thereby the bias mechanism 100 rotates relative to the vane rotor 14. In the above case, the bush 120 enables the bias mechanism 100 to smoothly rotate inside the second support hole 140 of the vane rotor 14. Also, the resilient member 110 is received between the shoe housing 12 and the bush 120. More specifically, the resilient member 110 has both end portions that are interposed between the shoe housing 12 and the contact part 142, which is the bottom portion 141 of the vane rotor 14, through the projection portion 121. The end portion of the resilient member 110 toward the shoe housing 12 and the projection portion 121 are smoothly pressed or urged along the inner peripheries of the first support hole 130 and the second support hole 140 in the longitudinal direction.

Due to the above, restoring force F of the resilient member 110 is effectively converted into the bias torque Tu through the projection portion 121 and the inclined planes of the contact parts 142. Moreover, because the resilient member 110 is received in the shoe housing 12 and the bush 120 that is integrally rotatable with the shoe housing 12, the resilient member 110 that generates restoring force F is limited from being worn out, and also the resilient member 110 is held contracted between the shoe housing 12 and the bush 120.

Also, in the present embodiment, the projection portion 121 is provided to the bottom portion 125 of the bush 120 radially outward of the insertion hole 126. In other words, the projection portions 121 are provided to the outer peripheral portion of the bush 120. Thus, the projection portions 121 are provided at radially outer parts of the bush 120, for example. In the above configuration, the same amount of the restoring force is capable of generating greater bias torque Tu compared with a case, where the projection portions 121 were provided at radially inner parts of the bush 120. Thus, when the projection portions 121 are provided at radially outer parts as above, bias torque Tu is maximized within the limitation of size of the bush 120 in the radial direction. In other words, because it is possible to keep small the restoring force F of the resilient member 110 while generating sufficiently required bias torque Tu, durability of the resilient member 110 is further improved.

Also, in the present embodiment, the projection portion 121 includes the ball 121*a* between the contact part 142 and the projection portion 121, and the ball 121*a* rolls on the contact part 142. Due to the above configuration, it is possible to always press the projection portion 121 against the contact part 142 through the ball 121*a* in the direction normal to the contact part 142. As a result, it is possible to increase flexibility in design (or flexibility in setting) of the inclined surface shape of the inclination portion (profile) of the contact part 142, and thereby it is possible to increase flexibility in design of the change rate of the bias torque Tu, which is limited by the inclination portion, relative to the cam angle phase (engine phase).

Also, in the present embodiment, because the resilient member 110 is the compression spring, hysteresis of the bias torque Tu is limited compared with a helical torsion spring or a spiral spring. Thus, the control unit 30 is capable of controlling the adjustment of the engine phase accurately to the target phase.

Also, in the present embodiment, the rotation component force $F_T$ is generated by bringing the projection portion 121 of the bias mechanism 100 into contact with the inclination portion of the contact part 142, and the rotation component force $F_T$ is set as the component force that biases the vane rotor 14 in a direction opposite from a direction of the average variable torque. Moreover, the inclination portion of the contact part 142 includes the inclined surface that is configured to increase the bias torque Tu accordingly based on a change of the position of the housing 11 with respect to the vane rotor 14 toward the retard position.

Due to the above configuration, the shape of the inclination portion (profile) is configured to set the bias torque of the contact part such that the bias torque is greater than the average variable torque and such that the bias torque becomes greater when the relative phase (engine phase) between both the rotors 11, 14 is shifted in the retard direction. As a result, even in a case, where hydraulic oil is not sufficiently supplied during the certain operational state, such as the starting of the engine, where influence of the variable torque is easily reflected, it is possible to shift the engine phase in the advance direction.

Second Embodiment

Figure 7A:
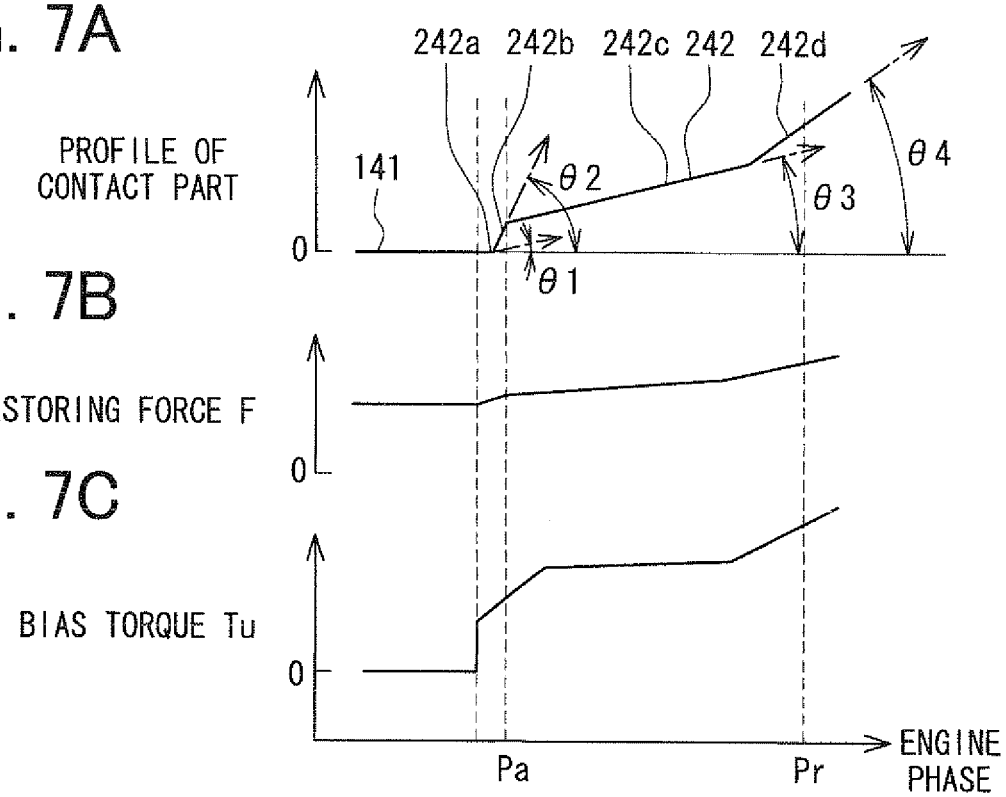
FIG. 7A is a characteristic diagram illustrating a profile of a contact part of a bias mechanism according to a valve timing adjusting apparatus of the second embodiment of the present invention.

As shown in FIG. 7, the second embodiment of the present invention is modification of the first embodiment. The second embodiment shows an example, where an inclination portion of a contact part 242, which is applied with restoring force F of the resilient member 110 through the projection portion 121, is characterized by multiple features (profile).

As shown in FIG. 7, the contact part 242 has a profile that shows multiple inclination portions 242*a* to 242*d*. In other words, the contact part 242 is configured to have the inclination portions 242*a* to 242*d*, which are angled relative to each other. More specifically, an angle defined between the inclination portion 242*a* and the bottom portion 141 has an inclination angle θ1, an angle defined between the inclination portion 242*b* and the bottom portion 141 has an inclination angle θ2, an angle defined between the inclination portion 242*c* and the bottom portion 141 has an inclination angle θ3, and an angle defined between the inclination portion 242*d* and the bottom portion 141 has an inclination angle θ4.

Thus, it is possible to set various torque characteristics of the bias torque by changing the angles of the inclination portions 242*a* to 242*d* relative to the bottom portion 141 without machining a compression spring of the resilient member 110 into a particular shape. In general, there is limitation in changing the restoring force characteristic of the resilient member by forming the resilient member into a certain shape Thus, in the present embodiment, flexibility in design of the torque characteristic for the bias torque is improved because it is easier to form the inclination portions 242*a* to 242*d* of the contact part into various shapes than forming the resilient member into the various shapes.

Also, in the inclination portions 242*a* to 242*d*, at least inclination angles θ2 to θ4 of the inclination portions 242*b* to 242*d* are set to satisfy the following relation of $\theta 3<\theta 2<\theta 4$. As above, the phase adjustment range of the engine phase corresponds to the angular range measured from the full advance phase Pa to the full retard phase Pr. In the phase adjustment range of the engine phase includes a normal adjustment range ranging from a vicinity of the full advance phase Pa to a vicinity of the full retard phase Pr, and the contact part 242 is made of the inclination portion 142*c* that has the inclination angle θ3 in the normal adjustment range. The inclination angle θ3 is configured to generally correspond in magnitude to the inclination angle θ in the first embodiment. It should be noted that in the present embodiment a relation of θ1<θ3 is satisfied.

According to the inclination portions 242*a* to 242*d*, the bias torque at the full retard position is effectively increased while the change rate of the bias torque is suppressed to be small in the normal adjustment range of the engine phase. As a result, in a case, where the engine phase is at the full retard position during the stop of the internal combustion engine, it is possible to prepare the engine ready for the next event of starting the engine. Therefore, it is possible to adjust the engine phase to the target phase precisely, and also to improve the startability of the internal combustion engine.

Third Embodiment

As shown in FIG. 8, the third embodiment of the present invention is modification of the first embodiment. In the third embodiment, a full advance phase Pa is defined by the lock pin 20 and the fitting hole 26 at an event of starting the engine, and also, a start intermediate phase Pm is defined by shapes of inclination portions 342*a*, 342*b* of a contact part 342 in addition to the above defined the engine phase (the full advance phase Pa).

Figure 8A:
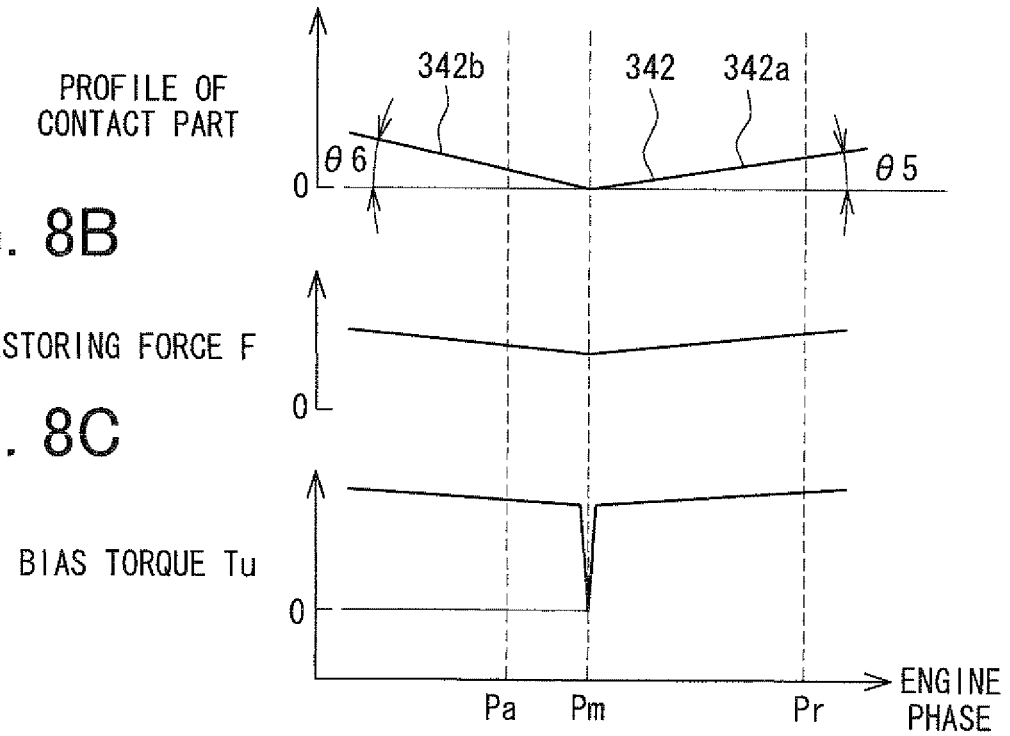
FIG. 8A is a characteristic diagram illustrating a profile of a contact part of a bias mechanism according to a valve timing adjusting apparatus of the third embodiment of the present invention.

As shown in FIG. 8, the contact part 342 includes a profile that shows the two inclination portions 342*a*, 342*b*. In other words, the contact part 342 is configured to have the inclination portions 342*a*, 342*b* that are angled relative to each other. More specifically, the inclination portion 342*a* corresponds to an inclination angle θ5, and the inclination portion 342*b* corresponds to an inclination angle θ6. In other words, the inclination portion 342*a* has a retard inclined surface that is angled by the inclination angle θ5 relative to a plane perpendicular to the longitudinal axis of the camshaft 2, and the inclination portion 342*b* has an advance inclined surface that is angled by the inclination angle θ6 relative to the above plane, for example. The inclination angle θ5 and the inclination angle θ6 are measured relative to the above plane opposite from each other as shown in FIG. 8A such that the inclination portions 342*a*, 342*b* are connected with each other at a position that corresponds to the start intermediate phase Pm of the engine phase, for example. Thus, the inclination portions 342*a*, 342*b* have a V-shaped or valley-shaped section taken along a plane extending in a longitudinal direction of the camshaft 2 as shown in FIG. 8A. The inclination angle θ5 corresponds in magnitude to the inclination angle θ of the first embodiment, and the inclination portion 342*a* is configured such that the bias torque Tu is changed as a function of a position in a range from the start intermediate phase Pm to the full retard phase Pr, and such that the bias torque Tu becomes greater when the engine phase is shifted toward the full retard phase Pr. In contrast, the inclination portion 342*b* is oppositely angled by the inclination angle θ6 in the engine phase range from the start intermediate phase Pm to the full advance phase Pa, and the inclination portion 342*b* is configured such that the bias torque Tu is increased when the engine phase is shifted toward the full advance phase Pa.

According to the inclination portions 342*a*, 342*b*, profiles of the inclination portions 342*a*, 342*b* show that a lift amount of each of the inclination portions 342*a*, 342*b* indicates zero at the start intermediate phase Pm. In other words, the lift amount by the contact part 342 indicated by the vertical axis of FIG. 8A corresponds to zero at the start intermediate phase Pm, for example. At the start intermediate phase Pm, the projection portion 120 or the ball 121*a* is not urged in the rotational direction from the inclination portions 342*a*, 342*b*, and thereby the rotation component force $F_T$ is not generated. As a result, the bias torque Tu is limited from being generated at the start intermediate phase Pm, and thereby the bias torque Tu is substantially small or zero. In contrast, the engine phase shifted in the advance direction or retard direction away from the start intermediate phase Pm indicates that the bias torque Tu is generated greater than the average variable torque as shown in FIG. 8C.

Because the change rate of the bias torque Tu as a function of the engine phase is suppressed to be very small within the phase adjustment range other than the start intermediate phase Pm, the control of the advance supply and retard supply by the control unit 30 is further facilitated when the engine phase is controlled by balancing the average variable torque, the bias torque, and the rotational torque that is controlled by the controlling of the advance supply and retard supply. As a result, the engine phase is accurately adjusted to the target phase.

In the present embodiment, the projection portion 121 is caused to be positioned between the retard inclined surface and the advance inclined surface at the contact part 342 when the engine phase is operated within the target phase region. As a result, in a case, where working fluid is not sufficiently supplied or supply of working fluid to the advance chamber and supply of working fluid to the retard chamber are stopped, erroneous control of the cam angle phase (engine phase) due to the variable torque is efficiently avoided.

Moreover, the bias torque Tu at the start intermediate phase Pm is substantially small or zero unlike the bias torque Tu at the engine phase shifted away from the start intermediate phase Pm in the advance direction or in the retard direction. Thus, when control of the advance supply and retard supply by the control unit set the engine phase at the start intermediate phase Pm, the engine phase is able to be held to the start intermediate phase Pm regardless of the influence of variable torque.

OTHER EMBODIMENT

Although some embodiments of the present invention have been described above, interpretation of the present invention is not limited to the above embodiments. The present invention is applicable to various embodiments provided that the various embodiments do not deviate from the gist of the present invention.

Specifically, the relation between "advance" and "retard" described in the above embodiments may be reversed in another embodiment. In other words, "advance" and "retard" defined in the above embodiments are interchangeable with each other in another embodiment.

Also, the inclination portion 142*a* of the contact part 142 may be configured to have an inclined surface shape that either increases or decreases restoring force F of the resilient member 110 relative to the projection portion 121 of the bush 120. Because the bias torque Tu generated by the bias mechanism 100 and the inclination portion 142*a* may be applied to shift the engine phase in the advance direction or the retard direction, the angle of the inclined surface of the inclination portion 142*a* is set as required.

Also, the bush 120 is provided to the shoe housing 12 such that the bush 120 is rotatable integrally with the shoe housing 12 and such that the bush 120 is displaceable in the longitudinal direction relative to the shoe housing 12. The bush 120 is provided to the vane rotor 14 such that the bush 120 is rotatable relative to the vane rotor 14 and the bush 120 is displaceable in the longitudinal direction relative to the vane rotor 14. However, the bush 120 is not limited to the above. Alternatively, the bush 120 may be provided such that the bush 120 is rotatable integrally with the vane rotor 14 and the bush 120 is displaceable in the longitudinal direction relative to the vane rotor 14. Also, the bush 120 may be provided to the shoe housing 12 such that the bush 120 is rotatable relative to the shoe housing 12 and the bush 120 is displaceable in the longitudinal direction relative to the shoe housing 12. In the above alternative case, the resilient member 110 is provided between the vane rotor 14 and the bush 120, and the inclination portion of the contact part is provided to the bottom portion of the shoe housing 12.

In the above embodiments, the resilient member 110 is the compression spring. However, the resilient member 110 is not limited to the above and alternatively, the resilient member 110 may be other resilient or elastic body that is capable of exerting restoring force when the resilient or elastic body is contracted in a longitudinal direction.

Further more, the above components 24, 26, 28, 29 that are associated with the lock pin 20 and the bias member 22 may not be provided in the drive unit 10.

Also, the pump 4 may employ an alternative pump provided that the alternative pump is capable of running synchronously with the internal combustion engine. For example, the pump 4 may employ an electric pump that operates in response to the energization for the operation of the internal combustion engine.

Also, the present invention is alternatively applicable to an apparatus for adjusting valve timing of an intake valve that serves as a "valve". In addition, the present invention is alternatively applicable to another apparatus for adjusting valve timing of both the intake valve and the exhaust valve.

Additional advantages and modifications will readily occur to those skilled in the art. The invention in its broader terms is therefore not limited to the specific details, representative apparatus, and illustrative examples shown and described.

What is claimed is:

1. A valve timing adjusting apparatus provided to a driving force transmission system that transmits driving force from a drive shaft of an internal combustion engine to a driven shaft that opens and closes at least one of an intake valve and an exhaust valve, wherein the valve timing adjusting apparatus adjusts timing of opening and closing the at least one of the intake and exhaust valves, the valve timing adjusting apparatus comprising:

a first rotor that is rotatable synchronously with the drive shaft;

a second rotor that is rotatable synchronously with the driven shaft, wherein:

the second rotor and the first rotor define therebetween an advance chamber and a retard chamber that are arranged one after another in a rotational direction;

the second rotor drives the driven shaft relative to the drive shaft in an advance direction when working fluid is supplied to the advance chamber; and the second rotor drives the driven shaft relative to the drive shaft in a retard direction when working fluid is supplied to the retard chamber; and a bias mechanism that is provided to one of the first and second rotors, wherein:

the bias mechanism includes a resilient member and a projection portion;

the projection portion is rotatable together with the one of the first and second rotors;

the projection portion is rotatable relative to the other one of the first and second rotors and contacts a contact part of the other one of the first and second rotors; and the resilient member and the projection portion are arranged such that restoring force of the resilient member is applied to the other one of the first and second rotors through the projection portion, wherein:

the contact part of the other one of the first and second rotors includes an inclination portion that is opposed to the projection portion;

the inclination portion is configured to increase and decrease restoring force of the resilient member;

the bias mechanism includes a support shaft portion receiving therein the resilient member and supporting the first and second rotors from inner sides of the first and second rotors;

the one of the first and second rotors includes a first support hole that opens to one end of the support shaft portion;

the first support hole receives therein the resilient member;

the other one of the first and second rotors includes a second support hole that opens to the other end of the support shaft portion, the other one of the first and second rotors receives the support shaft portion such that the support shaft portion is slidable along an inner periphery of the second support hole; and the contact part is provided at a bottom portion of the second support hole.

2. The valve timing adjusting apparatus according to claim 1, wherein the projection portion is provided at an outer peripheral portion of the support shaft portion.

3. The valve timing adjusting apparatus according to claim 1, wherein:

the projection portion has a rolling element at an end of the projection portion; and the rolling element rolls on the contact part.

4. The valve timing adjusting apparatus according to claim 1, wherein the resilient member is a compression spring.

5. The valve timing adjusting apparatus according to claim 1, wherein:

the restoring force has component force in the rotational direction;

the component force generates bias torque that biases the driven shaft in a direction opposite from a direction, in which average torque of variable torque applied to the driven shaft acts; and the inclination portion of the contact part includes an inclined surface that is configured to increase the bias torque accordingly based on a shift of a phase of the first rotor with respect to the second rotor in the retard direction.

6. The valve timing adjusting apparatus according to claim 5, wherein:

the inclined surface of the inclination portion of the contact part is a retard inclined surface;

the inclination portion of the contact part further includes an advance inclined surface that is configured to increase the bias torque accordingly based on the shift of the phase in the advance direction opposite from the retard direction; and the projection portion is caused to be positioned between the retard inclined surface and the advance inclined surface at the contact part.

7. The valve timing adjusting apparatus according to claim 1, further comprising:

a control unit that controls an advance supply operation that supplies working fluid to the advance chamber and controls a retard supply operation that supplies working fluid to the retard chamber.

8. A valve timing adjusting apparatus provided to a driving force transmission system that transmits driving force from a drive shaft of an internal combustion engine to a driven shaft that opens and closes at least one of an intake valve and an exhaust valve, wherein the valve timing adjusting apparatus adjusts timing of opening and closing the at least one of the intake and exhaust valves, the valve timing adjusting apparatus comprising:

a first rotor that is rotatable synchronously with the drive shaft;

a second rotor that is rotatable synchronously with the driven shaft, wherein:

the second rotor and the first rotor define therebetween an advance chamber and a retard chamber that are arranged one after another in a rotational direction;

the second rotor drives the driven shaft relative to the drive shaft in an advance direction when working fluid is supplied to the advance chamber; and the second rotor drives the driven shaft relative to the drive shaft in a retard direction when working fluid is supplied to the retard chamber; and a bias mechanism that is provided to one of the first and second rotors, wherein:

the bias mechanism includes a resilient member and a projection portion;

the projection portion is rotatable together with the one of the first and second rotors;

the projection portion is rotatable relative to the other one of the first and second rotors and contacts a contact part of the other one of the first and second rotors; and the resilient member and the projection portion are arranged such that restoring force of the resilient member is applied to the other one of the first and second rotors through the projection portion, wherein:

the contact part of the other one of the first and second rotors includes an inclination portion that is opposed to the projection portion;

the inclination portion is configured to increase and decrease restoring force of the resilient member;

the projection portion has a rolling element at an end of the projection portion; and the rolling element rolls on the contact part.

9. A valve timing adjusting apparatus provided to a driving force transmission system that transmits driving force from a drive shaft of an internal combustion engine to a driven shaft that opens and closes at least one of an intake valve and an exhaust valve, wherein the valve timing adjusting apparatus adjusts timing of opening and closing the at least one of the intake and exhaust valves, the valve timing adjusting apparatus comprising:

a first rotor that is rotatable synchronously with the drive shaft;

a second rotor that is rotatable synchronously with the driven shaft, wherein:

the second rotor and the first rotor define therebetween an advance chamber and a retard chamber that are arranged one after another in a rotational direction;

the second rotor drives the driven shaft relative to the drive shaft in an advance direction when working fluid is supplied to the advance chamber; and the second rotor drives the driven shaft relative to the drive shaft in a retard direction when working fluid is supplied to the retard chamber; and a bias mechanism that is provided to one of the first and second rotors, wherein:

the bias mechanism includes a resilient member and a projection portion;

the projection portion is rotatable together with the one of the first and second rotors;

the projection portion is rotatable relative to the other one of the first and second rotors and contacts a contact part of the other one of the first and second rotors; and the resilient member and the projection portion are arranged such that restoring force of the resilient member is applied to the other one of the first and second rotors through the projection portion, wherein:

the contact part of the other one of the first and second rotors includes an inclination portion that is opposed to the projection portion;

the inclination portion is configured to increase and decrease restoring force of the resilient member;

the restoring force has component force in the rotational direction;

the component force generates bias torque that biases the driven shaft in a direction opposite from a direction, in which average torque of variable torque applied to the driven shaft acts; and the inclination portion of the contact part includes an inclined surface that is configured to increase the bias torque accordingly based on a shift of a phase of the first rotor with respect to the second rotor in the retard direction.

10. The valve timing adjusting apparatus according to claim 9, wherein:

the inclined surface of the inclination portion of the contact part is a retard inclined surface;

the inclination portion of the contact part further includes an advance inclined surface that is configured to increase the bias torque accordingly based on the shift of the phase in the advance direction opposite from the retard direction; and the projection portion is caused to be positioned between the retard inclined surface and the advance inclined surface at the contact part.

* * * * *